US009906873B2

(12) United States Patent
Zhang

(10) Patent No.: US 9,906,873 B2
(45) **Date of Patent: *Feb. 27, 2018**

(54) METHODS AND APPARATUS FOR IMPROVING SPEECH UNDERSTANDING IN A LARGE CROWD

(71) Applicant: Starkey Laboratories, Inc., Eden Prairie, MN (US)

(72) Inventor: Tao Zhang, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/137,267

(22) Filed: Apr. 25, 2016

(65) Prior Publication Data

US 2017/0026761 A1 Jan. 26, 2017

Related U.S. Application Data

(63) Continuation of application No. 13/947,931, filed on Jul. 22, 2013, now Pat. No. 9,326,078.

(Continued)

(51) Int. Cl.
*H04R 25/00* (2006.01)

(52) U.S. Cl.
CPC ..... *H04R 25/505* (2013.01); *H04R 25/43* (2013.01); *H04R 25/554* (2013.01);

(Continued)

(58) Field of Classification Search
CPC ..... H04R 25/554; H04R 2225/55; H04R 25/558; H04R 25/305; H04R 25/407;

(Continued)

(56) References Cited

U.S. PATENT DOCUMENTS 5,390,254 A 2/1995 Adelman
5,475,759 A * 12/1995 Engebretson ..... H03H 17/0261 381/312

(Continued)

FOREIGN PATENT DOCUMENTS

WO WO-2011131241 A1 10/2011

OTHER PUBLICATIONS

"U.S. Appl. No. 13/947,931, Final Office Action dated Feb. 13, 2015", 22 pgs.

(Continued)

*Primary Examiner* — Norman Yu
(74) *Attorney, Agent, or Firm* — Schwegman Lundberg & Woessner, P.A.

(57) ABSTRACT

Methods and devices are described for improves speech understanding by hearing aid users in crowded environments. In one embodiment, a hearing aid wearer's speech signal is extracted using the microphone or microphones in the hearing aid. The hearing aid is configured to wirelessly transmit the extracted speech signals to a central processing station that enhances the extracted speech signals received from all registered hearing aids. The central processing station processes the received speech signals individually based on provided hearing losses mixes the signals based on the provided preferences, wirelessly transmits the mixed signal to each registered hearing aid for play back.

20 Claims, 3 Drawing Sheets

Related U.S. Application Data

(60) Provisional application No. 61/674,581, filed on Jul. 23, 2012.

(52) U.S. Cl.
CPC ..... *H04R 25/558* (2013.01); *H04R 2225/021* (2013.01); *H04R 2225/023* (2013.01); *H04R 2225/025* (2013.01); *H04R 2225/43* (2013.01); *H04R 2225/55* (2013.01)

(58) Field of Classification Search
CPC ..... H04R 2225/41; H04R 25/70; H04R 2227/003; H04R 2460/07; H04R 25/50; H04R 25/505; H04R 27/02; H04R 19/016; H04R 1/1083; H04R 2410/05; H04R 2410/07; H04R 2420/07; H04R 2499/11; H04R 25/30; H04R 25/55; H04R 3/00; H04R 3/005; H04M 1/72591; H04M 1/6016; H04M 1/6066; H04M 1/2155; H04M 1/2475; G10L 21/0208; G10L 21/0364
USPC ..... 381/315, 312, 122, 23.1, 317, 320, 321, 381/56
See application file for complete search history.

(56) References Cited

U.S. PATENT DOCUMENTS

| | | | | |
|---|---|---|---|---|
| 5,721,783 | A | 2/1998 | Anderson | |
| 9,326,078 | B2 | 4/2016 | Zhang | |
| 2004/0022393 | A1* | 2/2004 | Jones | H04R 3/00 381/56 |
| 2005/0135644 | A1 | 6/2005 | Qi | |
| 2007/0286350 | A1 | 12/2007 | Krause et al. | |
| 2009/0047994 | A1* | 2/2009 | Sommer | H04M 1/7253 455/556.1 |
| 2010/0086152 | A1 | 4/2010 | Rank et al. | |
| 2010/0086156 | A1 | 4/2010 | Rank et al. | |
| 2012/0114158 | A1 | 5/2012 | Gysin | |
| 2012/0183165 | A1* | 7/2012 | Foo | H04R 25/50 381/314 |
| 2014/0023217 | A1 | 1/2014 | Zhang | |

OTHER PUBLICATIONS

"U.S. Appl. No. 13/947,931, Non Final Office Action dated Jul. 16, 2015", 15 pgs.
"U.S. Appl. No. 13/947,931, Non Final Office Action dated Jul. 28, 2014", 23 pgs.
"U.S. Appl. No. 13/947,931, Notice of Allowance dated Dec. 24, 2015", 5 pgs.
"U.S. Appl. No. 13/947,931, Response filed Jun. 15, 2015 to Final Office Action dated Feb. 13, 2015", 9 pgs.
"U.S. Appl. No. 13/947,931, Response filed Oct. 15, 2015 to Non Final Office Action dated Jul. 16, 2015", 8 pgs.
"U.S. Appl. No. 13/947,931, Response filed Nov. 26, 2014 to Non Final Office Action dated Jul. 28, 2014", 14 pgs.
"European Application Serial No. 13177632.0 Response filed Jan. 26, 2015 to Examination Notification Art. 94(3) dated Sep. 17, 2014", With the amended claims, 15 pgs.
"European Application Serial No. 13177632.0, Communication for Oral Proceedings dated Jan. 14, 2016", 2 pgs.
"European Application Serial No. 13177632.0, Examination Notification Art. 94(3) dated Sep. 17, 2014", 6 pgs.
"European Application Serial No. 13177632.0, Extended European Search Report dated Oct. 2, 2013", 7 pgs.
"European Application Serial No. 13177632.0, Response filed Jan. 27, 2016 to Communication for Oral Proceedings dated Jan. 14, 2016", 22 pgs.
"European Application Serial No. 13177632.0, Summons to Attend Oral Proceedings dated Mar. 11, 2015", 4 pgs.
"European Application Serial No. 13177632.0,Response filed Dec. 18, 2015 to Summons to Attend Oral Proceedings dated Mar. 11, 2015", 20 pgs.

* cited by examiner

METHODS AND APPARATUS FOR IMPROVING SPEECH UNDERSTANDING IN A LARGE CROWD

RELATED APPLICATION(S)

The present application is a continuation of U.S. patent application Ser. No. 13/947,931, filed Jul. 22, 2013, which claims the benefit of priority under 35 U.S.C. § 119(e) to U.S. Provisional Application No. 61/674,581 filed on Jul. 23, 2012, each of which are incorporated herein by reference in their entirety

TECHNICAL FIELD

This application relates generally to hearing assistance devices and, more particularly, to method and apparatus for better understanding of speech using hearing assistance devices.

BACKGROUND

Understanding speech in a large crowd (such as a noisy room or cocktail party) remains to be one of the most challenging problems for hearing impaired subjects due to reverberation and multiple dynamic interferences. In some prior approaches, monaural or binaural microphone arrays have been used to improve speech understanding in such an environment. Due to reverberation and multiple dynamic interferences, the benefits have been limited in real-world situations. Monaural or binaural noise reduction algorithms have also been used to improve speech understanding in such scenarios. However, there is a need for improved speech understanding over what is currently available.

DETAILED DESCRIPTION

Figure 1:
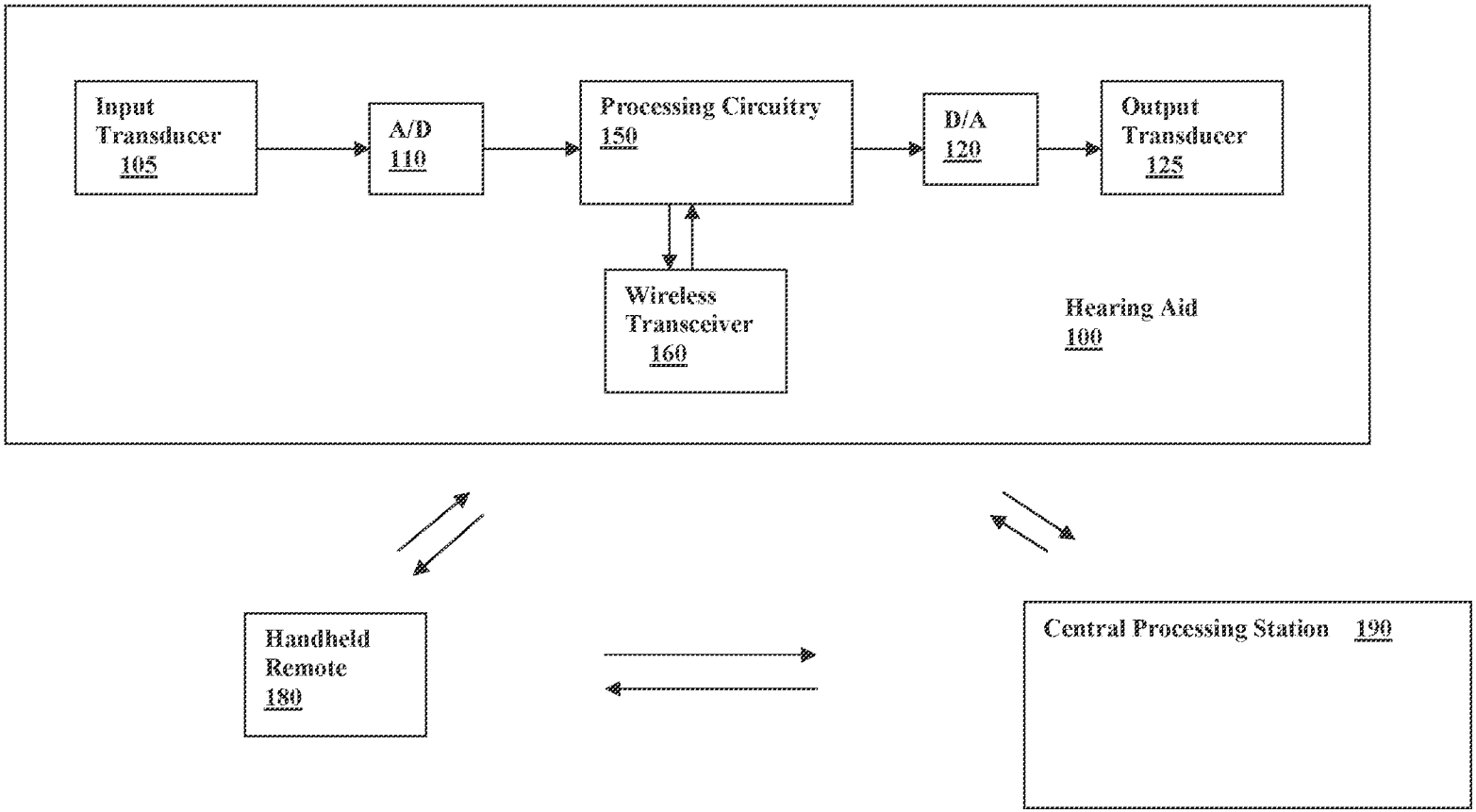
FIG. 1 illustrates basic components of an example hearing aid.

The following detailed description of the present subject matter refers to the accompanying drawings which show, by way of illustration, specific aspects and embodiments in which the present subject matter may be practiced. These embodiments are described in sufficient detail to enable those skilled in the art to practice the present subject matter. Other embodiments may be utilized and structural, logical, and electrical changes may be made without departing from the scope of the present subject matter. References to "an", "one", or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

The present subject matter improves speech understanding. In various embodiments, it improves speech understanding such that in environments, such as a large group scenario it extracts a wearer's speech signal using the microphone or microphones in each hearing aid. In various embodiments, it is configured to wirelessly transmit the extracted speech signals to a central processing station, and leverage the central processing station to enhance the extracted speech signals from all registered hearing aids, compress them individually based on the provided hearing losses and mixing them based on the provided preferences, wirelessly transmit the mixed signal to the hearing aid, and play back the mixed signal in the hearing aid.

In various embodiments, the present subject matter relies on the one or more microphones on each hearing aid to extract the wearer's own voice. The extracted own voice is sent to the central processing station wirelessly to be enhanced, compressed and mixed with other processed speech signals based on the wearer's hearing loss and preference. The mixed signal is sent back to the hearing aid wirelessly. Each wearer can select the speech signals they want to listen and enhance by providing such information to the central processing station.

One advantage of the present subject matter is that its performance doesn't have a strong dependency on reverberation or other interferences because each hearing aid can extract the wearer's own voice based on proximity or a near-field array processing. Another advantage is that each individual's own voice can be individually enhanced, compressed and mixed in the central processing station based on the wearer's hearing loss and preference. Yet another advantage is that the solution is feasible for hearing aids because it can use a full-duplex wireless link for each hearing aid and the most computationally expensive processing is done in the central processing station where computational power, storage and current consumption constraints are largely reduced. Other advantages are possible for different embodiments and applications of the present subject matter and the list provided herein are not intended to be exhaustive or exclusive or necessary in every implementation.

There are several ways to extract an individual's speech signal in a cocktail party environment, and some include, but are not limited to the following. For a person who wears hearing aids, a microphone in the ear canal may be used to extract the wearer's own voice. For a person who wears hearing aids, the external hearing aid microphone may be used to extract the wearer's own voice. For a person who wears hearing aids, the hearing aid microphones on the same hearing aid (or bilateral hearing aids) may be used to extract the wearer's own voice using a near-field array. For a person who does not wear hearing aids, the microphones from nearby hearing aids may be used to form a distributed array or a microphone not incorporated into a hearing aid may be used.

The extracted speech signal is not significantly affected by reverberation and the presence of interferences in the environment due to the close proximity of the microphone(s). In various embodiments, the proper head related transfer functions (HRTFs) can be applied to the extracted speech signal if desired.

A central processing station may be designed to communicate with multiple hearing aids simultaneously. In some embodiments, each hearing aid communicates with the central processing station using a full-duplex wireless link. In some embodiments, each hearing aid can pair and register with the central processing station until its wireless communication capacity has been reached. In some embodiments, each hearing aid can send the associated hearing loss and the user's preference for sound quality, noise comfort and speech intelligibility to the central processing station. In some embodiments, each hearing aid wearer can select the desired speakers they want to listen to by using a remote control or when a new user registers with the central processing station. In some embodiments, each hearing aid extracts the individual's own voice, encodes it and sends the encoded signal to the central processing station. In some such embodiments, for each hearing aid, the central processing station takes each extracted speech signal, compresses it and mixes it with the compressed signal from other talkers according to a provided hearing loss and preference. In some embodiments, it is possible to emphasize a particular talker's speech based on a user preference during the compression and mixture. The mixed signal is sent to the hearing aid of that user to be played out.

In some embodiments, the central station is used in processing the signal by taking a microphone signal, converting it to a digital representation, encoding the signal, transmitting the encoded signal to a central processing station, processing the encoded signal, and then sending the processed version of the encoded signal to be decoded by the hearing aid. The resulting signal is converted back into an analog representation for use by the hearing aid. Alternatively, a hearing aid can mix the processed signal from the central processing station and the processed signal from its own microphone and play back the mixed signal.

Alternatively, multiple central processing stations may be used instead of a single central processing station. In this case, each central processing station communicates with a subset of hearing aids. The central processing station processes the microphone signals from each hearing aid for each user and exchanges the processed signals with another central processing station using a high-speed wireless link. Each central processing station sends the processed signal for each user back to each hearing aid.

FIG. 1 illustrates the components of an example hearing aid 100 that communicates wirelessly with a central processing station 190 and a remote unit 180. The hearing aid 100 includes an input transducer or microphone 105 for generating an audio signal, an analog-to-digital converter 110 for digitizing the audio signal, processing circuitry 150 for performing hearing loss compensation such as compression on the digitized audio signal according to specified hearing loss parameters, a digital-to-analog converter 120, and an output transducer 125 that may include an amplifier and speaker for receiving the processed audio signal and outputting sound. A wireless transceiver 160 enables wireless communication with the central processing station 190 and remote unit 180.

Figure 2:
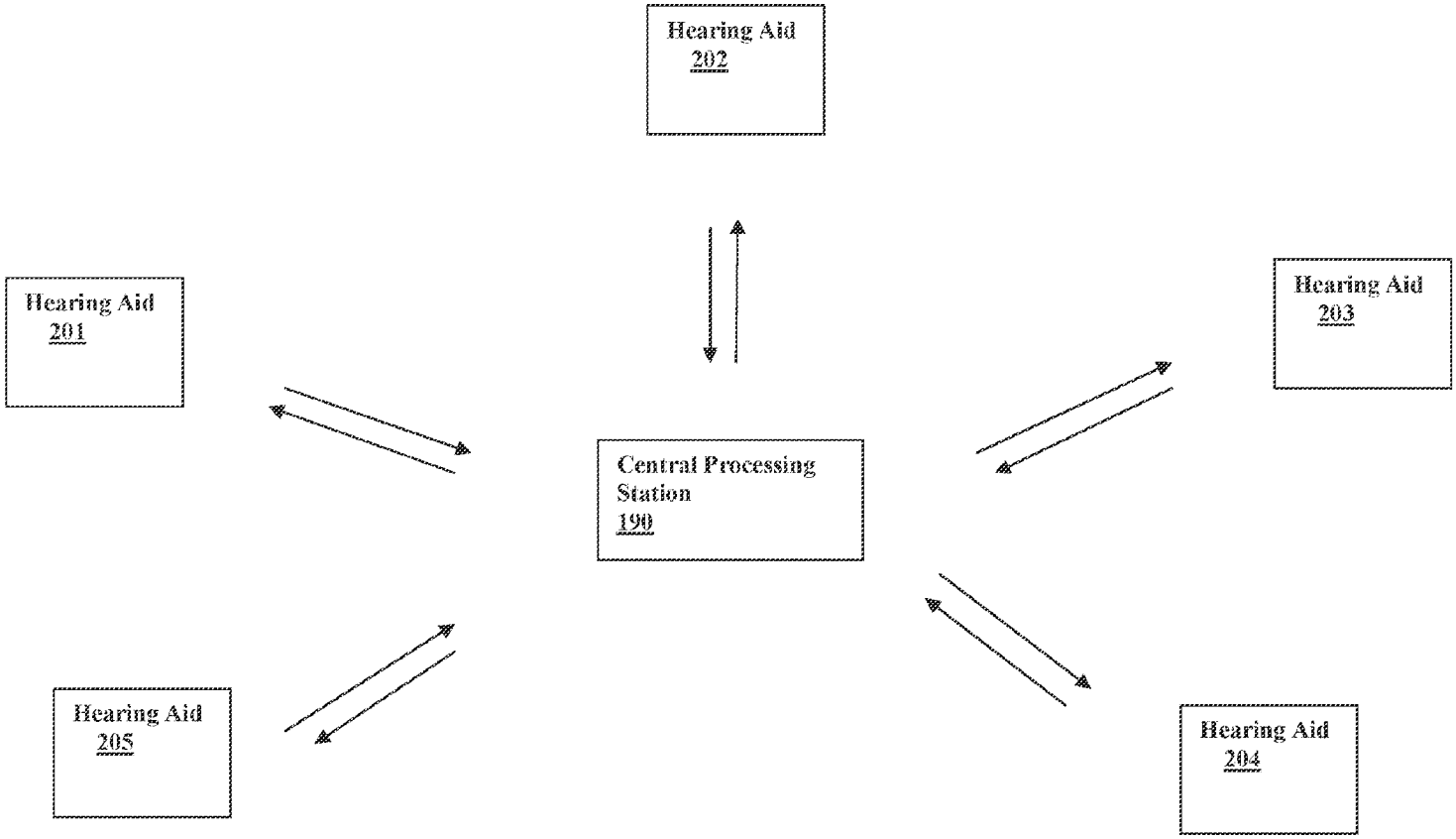
FIG. 2 illustrates an example of a central processing station communicating with a plurality of hearing aids.

FIG. 2 illustrates an example system for operating in the manner described above to enhance speech understanding. A central processing station 190 is shown as communicating with a plurality of hearing aids 201 through 205. Each of the hearing aids 201 through 205 are worn by a different user and may comprise either one or two hearing aids worn the user.

Figure 3:
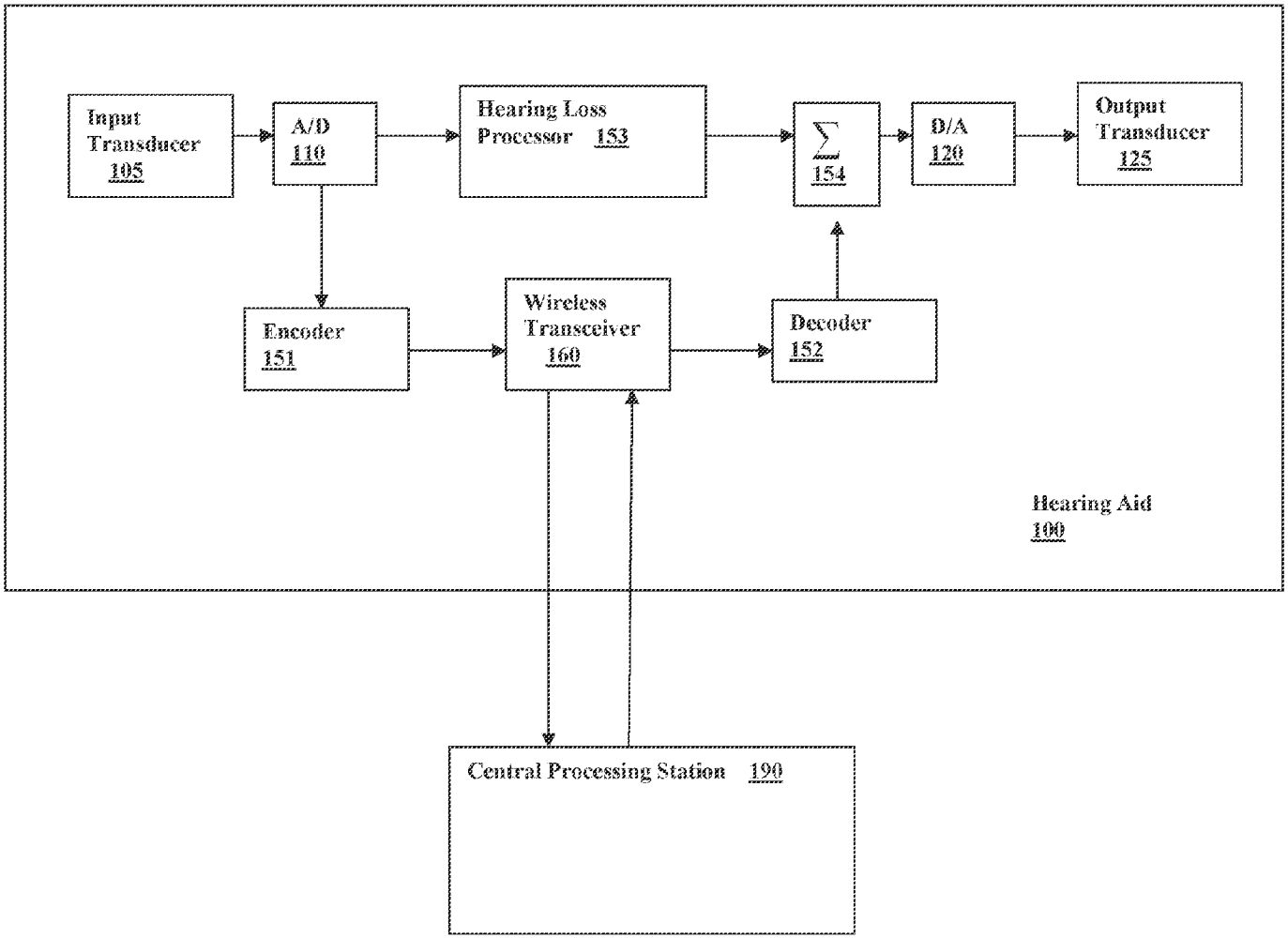
FIG. 3 illustrates the audio signal flow for a hearing aid acting as both a source hearing aid and a target hearing aid.

FIG. 3 illustrates the audio signal flow for a hearing aid 100 that both acts as a source hearing aid for transmitting audio signals to the central processing station 190 and acts as a target hearing aid for receiving processed audio signals from the central processing station. The encoder 151, hearing loss processor 153, decoder 152, and summer 154 may all be implemented by the processing circuitry 150 shown in FIG. 1. When acting as a source hearing aid, the digitized audio signal received from the input transducer 105 is encoded by encoder 151 and transmitted to the central processing station via wireless transceiver 160. When acting as a target hearing aid, an encoded and processed audio signal is received from the central processing station 190 and decoded by decoder 152. In one embodiment, the decoded and processed signal received from the central processing station is summed by summer 154 with the audio signal generated by the input transducer 105 and processed by hearing loss processor 153 before being played back by output transducer 125. In another embodiment, the hearing loss processor 153 may be disabled during playback of audio signals received from the central processing station 160 so that the received audio signal is played back without summing with a signal generated by the hearing aid itself.

In one embodiment, a method for improving speech understanding in noisy environments using a plurality of hearing aids operating a cooperative mode, comprises: extracting a hearing aid user's speech signal using the microphone or microphones in each hearing aid; wirelessly transmitting the extracted speech signals to a central processing station; operating the central processing station to enhance the extracted speech signals from each hearing aid, by processing the extracted speech signals individually based on provided hearing loss parameters from each hearing aid, and mixing the processed signals based on provided preferences; and wirelessly transmitting the mixed signal to each hearing aid and playing back the mixed signal in each hearing aid. The method may include wherein the extracted speech signals are additionally generated by and transmitted from microphones not incorporated into hearing aids. The method may further comprise each hearing aid playing back the received mixed signal summed with an processed audio signal generated by its own input transducer. The method may further comprise each hearing aid playing back the received mixed signal while disabling processing of audio signals generated by its own input transducer. The method may further comprise processing the extracted speech signals in a manner that emphasizes a particular user's speech according to a preference selected by a user of a hearing aid that receives the mixed signal.

In another embodiment, a system for improving speech understanding in noisy environments, comprises: a central processing station that includes processing circuitry and wireless communication circuitry; a plurality of hearing aids for wearing by a plurality of users, wherein each hearing aid includes an input transducer, an output transducer, processing circuitry, and a wireless transceiver for communicating with the central processing station; and, wherein the processing circuitries of the hearing aids and the central processing station are configured to in a cooperative mode where: the hearing aid may act as either a target hearing aid or a source hearing aid, the source hearing aid encodes and transmits audio signals received by its input transducer to the central processing station, the central processing station performs hearing loss compensation according to hearing loss parameters specified for the target hearing aid on the received encoded audio signals and transmits the compensated signals to the target hearing aid, and the target hearing aid decodes the compensated signals received from the central processing station and plays back the decoded signals through its output transducer. The processing circuitry of the central processing station may be further configured to performs hearing loss compensation according to hearing loss parameters specified for the target hearing aid on audio signals received from one or more microphones that are not incorporated into hearing aids and transmit the compensated signals to the target hearing aid. The central processing station may be further configured to receive encoded audio signals from a plurality of audio sources that may include one or more additional target hearing aids or microphones not incorporated into hearing aids, perform hearing loss compensation according to hearing loss parameters specified for the target hearing aid on the received encoded audio signals, and transmit the compensated signals to the target hearing aid. The central processing station may be further configured to process the encoded audio signals received from the plurality of audio sources that emphasizes a particular audio source according to a preference selected by a user of the target hearing aid. The central processing station may be further configured to perform hearing loss compensation according to hearing loss parameters specified for a plurality of target hearing aids on encoded audio signals received from one or more source hearing aids or microphones not incorporated into hearing aids and transmit the compensated signals to each of the target hearing aids. A hearing aid of the plurality may be configured to enter the cooperative mode upon selection by the user of the hearing aid operating a remote unit. When acting as a target hearing aid, the processing circuitry of the hearing aid may be configured to decode the audio signal received from the central processing station and sum the decoded audio signal with a processed audio signal generated by its own input transducer. When acting as a target hearing aid, the processing circuitry of the hearing aid may be configured to decode the audio signal received from the central processing station and output the decoded audio signal through its output transducer while disabling processing of audio signals generated by its own input transducer. The system may further comprise a plurality of central processing stations, each of which is configured to perform hearing loss compensation according to hearing loss parameters specified for a hearing aid acting as a target hearing aid on received encoded audio signals and transmit the compensated signals to the hearing aid.

In another embodiment, a hearing aid, comprises: input and output transducers for receiving and outputting sound, respectively; processing circuitry for performing hearing loss compensation on audio signals received by the input transducer; and, wherein the processing circuitry is further configured to operate in a cooperative mode by: encoding and transmitting audio signals received by the input transducer to a central processing station, receiving and decoding encoded hearing loss compensated signals from the central processing station, and playing back the decoded signals through the output transducer. The processing circuitry may be further configured to decode the audio signal received from the central processing station, sum the decoded audio signal with a processed audio signal generated by the input transducer, and output the summed signals through the output transducer. The processing circuitry may be further configured to decode the audio signal received from the central processing station and output the decoded audio signal through the output transducer while disabling processing of audio signals generated by the input transducer.

In another embodiment, a central processing station for improving speech understanding by hearing aid users, comprises: processing circuitry and wireless communication circuitry for communicating with one or more hearing aids; and, wherein the processing circuitry is configured to receive encoded audio signals from one or more source hearing aids or other audio sources, perform hearing loss compensation according to hearing loss parameters specified for a target hearing aid on the received encoded audio signals, and transmit the compensated encoded audio signals to the target hearing aid for decoding and playing back by the target hearing aid. The processing circuitry may be configured to perform hearing loss compensation according to hearing loss parameters specified for a plurality of target hearing aids on the received encoded audio signals and transmit the compensated encoded audio signals to the target hearing aids for decoding and playing back by each target hearing aid. The processing circuitry may be further configured to allow registration from a hearing aid for acting as either a source hearing aid or a target hearing aid.

It is understood that the hearing aids referenced in this patent application include a processing circuitry. The processing circuitry may be a digital signal processor (DSP), microprocessor, microcontroller, or other digital logic. The processing of signals referenced in this application can be performed using the processing circuitry. Processing may be done in the digital domain, the analog domain, or combinations thereof. Processing may be done using subband processing techniques. Processing may be done with frequency domain or time domain approaches. For simplicity, in some examples blocks used to perform frequency synthesis, frequency analysis, analog-to-digital conversion, amplification, and certain types of filtering and processing may be omitted for brevity. In various embodiments the processor is adapted to perform instructions stored in memory which may or may not be explicitly shown. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, realizations of the block diagrams, circuits, and processes set forth herein may occur without departing from the scope of the present subject matter.

The present subject matter can be used for a variety of hearing assistance devices, including but not limited to, cochlear implant type hearing devices, hearing aids, such as behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user. Such devices are also known as receiver-in-the-canal (RIC) or receiver-in-the-ear (RITE) hearing instruments. It is understood that other hearing assistance devices not expressly stated herein may fall within the scope of the present subject matter.

The methods illustrated in this disclosure are not intended to be exclusive of other methods within the scope of the present subject matter. Those of ordinary skill in the art will understand, upon reading and comprehending this disclosure, other methods within the scope of the present subject matter. The above-identified embodiments, and portions of the illustrated embodiments, are not necessarily mutually exclusive.

The above detailed description is intended to be illustrative, and not restrictive. Other embodiments will be apparent to those of skill in the art upon reading and understanding the above description. The scope of the invention should, therefore, be determined with reference to the appended claims, along with the full scope of equivalents to which such claims are entitled.

What is claimed is:

1. A system, comprising:

a central processing station that includes processing circuitry and wireless communication circuitry;

a plurality of hearing aids for wearing by a plurality of users, wherein each hearing aid includes an input transducer, an output transducer, processing circuitry, and a wireless transceiver for communicating with the central processing station;

wherein the processing circuitries of the hearing aids and the central processing station are configured to operate in a cooperative mode where: one of the hearing aids acts as a target hearing aid and another of the hearing aids acts as a source hearing aid, the source hearing aid encodes and transmits audio signals generated by its input transducer to the central processing station, the central processing station performs hearing loss compensation according to hearing loss parameters specified for the target hearing aid on the received encoded audio signals and transmits the compensated signals to the target hearing aid, and the target hearing aid decodes the compensated signals received from the central processing station; and, wherein the target hearing aid is configured to process an audio signal generated by the target hearing aid's input transducer with a hearing loss processor, sum the hearing loss processed signal with the decoded audio signal received from the central processing station, and play back the summed signals through the target hearing aid's output transducer.

2. The system of claim 1 wherein the processing circuitry of the central processing station is further configured to perform hearing loss compensation according to hearing loss parameters specified for the target hearing aid on audio signals received from one or more microphones that are not incorporated into hearing aids and transmit the compensated signals to the target hearing aid.

3. The system of claim 1 wherein the central processing station is configured to receive encoded audio signals from a plurality of audio sources, perform hearing loss compensation according to hearing loss parameters specified for the target hearing aid on the received encoded audio signals, and transmit the compensated signals to the target hearing aid.

4. The system of claim 3 wherein the central processing station is configured to process the encoded audio signals received from the plurality of audio sources that emphasizes a particular audio source according to a preference selected by a user of the target hearing aid.

5. The system of claim 1 wherein the central processing station is configured to perform hearing loss compensation according to hearing loss parameters specified for a plurality of target hearing aids on encoded audio signals received from one or more source hearing aids or microphones not incorporated into hearing aids and transmit the compensated signals to each of the target hearing aids.

6. The system of claim 1 wherein a hearing aid of the plurality of hearing aids is configured to enter the cooperative mode upon selection by the user of the hearing aid operating a remote unit.

7. The system of claim 1 wherein the target hearing aid is further configured to disable processing of audio signals generated by its own input transducer.

8. The system of claim 1 further comprising a plurality of central processing stations, each of which is configured to perform hearing loss compensation according to hearing loss parameters specified for a hearing aid acting as a target hearing aid on received encoded audio signals and transmit the compensated signals to the hearing aid.

9. A hearing aid comprising:

input and output transducers for receiving and outputting sound, respectively;

processing circuitry including a hearing loss processor for performing hearing loss compensation on audio signals received from the input transducer;

wherein the processing circuitry is further configured to operate in a cooperative mode by: receiving and decoding encoded hearing loss compensated signals from a central processing station, process an audio signal generated by the input transducer with the hearing loss processor, sum the hearing loss processed signal with the decoded audio signal received from the central processing station, and play back the summed signals through the output transducer; and, wherein the encoded hearing loss compensated signals from the central processing station are based on audio signals generated by an input transducer of another hearing aid.

10. The hearing aid of claim 9 wherein the processing circuitry is configured to enter the cooperative mode upon selection by the user of the hearing aid operating a remote unit.

11. The hearing aid of claim 9 wherein the processing circuitry is configured to provide hearing loss parameters to the central processing station in accordance with which the central processing station performs hearing loss compensation on signals transmitted to the hearing aid.

12. The hearing aid of claim 9 wherein the hearing aid is configured to disable processing of audio signals generated by the input transducer.

13. A method, comprising:

transmitting audio signals generated by an input transducer of a source hearing aid to a central processing station;

the central processing station performing hearing loss compensation according to hearing loss parameters specified for a target hearing aid on received encoded audio signals and transmitting compensated signals to the target hearing aid, the target hearing aid decoding the compensated signals received from the central processing station, processing an audio signal generated by the target hearing aid's input transducer with a hearing loss processor, summing the hearing loss processed signal with the decoded audio signal received from the central processing station, and playing back the summed signals through the target hearing aid's output transducer.

14. The method of claim 13 further comprising the central processing station performing hearing loss compensation according to hearing loss parameters specified for the target hearing aid on audio signals received from one or more microphones that are not incorporated into hearing aids and transmitting the compensated signals to the target hearing aid.

15. The method of claim 13 further comprising the central processing station receiving encoded audio signals from a plurality of audio sources, performing hearing loss compensation according to hearing loss parameters specified for the target hearing aid on the received encoded audio signals, and transmitting the compensated signals to the target hearing aid.

16. The method of claim 13 further comprising the central processing station processing the encoded audio signals received from the plurality of audio sources that emphasizes a particular audio source according to a preference selected by a user of the target hearing aid.

17. The method of claim 13 further comprising the central processing performing hearing loss compensation according to hearing loss parameters specified for a plurality of target hearing aids on encoded audio signals received from one or more source hearing aids or microphones not incorporated into hearing aids and transmitting the compensated signals to each of the target hearing aids.

18. The method of claim 13 further comprising the target hearing aid entering the cooperative mode upon selection by a user of the target hearing aid operating a remote unit.

19. The method of claim 13 further comprising the target hearing disabling processing of audio signals generated by its own input transducer.

20. The method of claim 13 further comprising a plurality of central processing stations performing hearing loss compensation according to hearing loss parameters specified for the target hearing aid on received encoded audio signals and transmitting the compensated signals to the target hearing aid.

* * * * *